US011104983B2

(12) United States Patent
Terasaki et al.

(10) Patent No.: US 11,104,983 B2
(45) Date of Patent: Aug. 31, 2021

(54) METHOD OF PRODUCING HOT-DIP METAL COATED STEEL STRIP AND CONTINUOUS HOT-DIP METAL COATING APPARATUS

(71) Applicant: JFE STEEL CORPORATION, Tokyo (JP)

(72) Inventors: Yu Terasaki, Tokyo (JP); Hideyuki Takahashi, Tokyo (JP); Yusuke Yasufuku, Tokyo (JP); Takumi Koyama, Tokyo (JP); Atsushi Inaba, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 62 days.

(21) Appl. No.: 16/316,424

(22) PCT Filed: May 30, 2017

(86) PCT No.: PCT/JP2017/020142
§ 371 (c)(1),
(2) Date: Jan. 9, 2019

(87) PCT Pub. No.: WO2018/012132
PCT Pub. Date: Jan. 18, 2018

(65) Prior Publication Data

US 2019/0300997 A1 Oct. 3, 2019

(30) Foreign Application Priority Data

Jul. 13, 2016 (JP) ..... JP2016-138823

(51) Int. Cl.
*C23C 2/20* (2006.01)
*C22C 18/04* (2006.01)
(Continued)

(52) U.S. Cl.
CPC ..... *C23C 2/20* (2013.01); *C22C 18/04* (2013.01); *C22C 21/10* (2013.01); *C23C 2/003* (2013.01);
(Continued)

(58) Field of Classification Search
CPC .... C23C 2/20; C23C 2/14; C23C 2/06; C23C 2/40
See application file for complete search history.

(56) References Cited

U.S. PATENT DOCUMENTS 3,459,587 A 8/1969 Hunter et al.
3,607,366 A 9/1971 Kurokawa
(Continued)

FOREIGN PATENT DOCUMENTS

EP 3205741 A1 * 8/2017 ..... C23C 2/06
EP 3205741 A1 8/2017
(Continued)

OTHER PUBLICATIONS

Apr. 29, 2020, Office Action issued by the China National Intellectual Property Administration in the corresponding Chinese Patent Application No. 201780042945.1 with English language search report.
(Continued)

*Primary Examiner* — Hai Y Zhang
(74) *Attorney, Agent, or Firm* — Kenja IP Law PC

(57) ABSTRACT

Disclosed is a method of producing a hot-dip metal coated steel strip capable of sufficiently suppressing generation of bath wrinkles and producing high-quality hot-dip metal coated steel strip at low cost. The disclosed method of producing a hot-dip metal coated steel strip includes: blowing a gas from a pair of gas wiping nozzles 20A and 20B to a steel strip S while being pulled up from a molten metal bath 14 so as to adjust a coating weight of molten metal on
(Continued)

both sides of the steel strip S, in which each of the gas wiping nozzles 20A and 20B includes an injection port portion that is installed downward with respect to a horizontal plane such that an angle formed by the injection port portion and the horizontal plane is 10° or more and 75° or less, and has a header pressure below 30 kPa.

4 Claims, 4 Drawing Sheets

(51) Int. Cl.

| | |
|---|---|
| ***C22C 21/10*** | (2006.01) |
| ***C23C 2/00*** | (2006.01) |
| ***C23C 2/06*** | (2006.01) |
| ***C23C 2/12*** | (2006.01) |
| ***C23C 2/40*** | (2006.01) |
| ***C23C 2/16*** | (2006.01) |
| ***C23C 2/18*** | (2006.01) |
| ***C23C 2/14*** | (2006.01) |

(52) U.S. Cl.
CPC ..... *C23C 2/06* (2013.01); *C23C 2/12* (2013.01); *C23C 2/14* (2013.01); *C23C 2/16* (2013.01); *C23C 2/18* (2013.01); *C23C 2/40* (2013.01)

(56) References Cited

U.S. PATENT DOCUMENTS

| | | | | |
|---|---|---|---|---|
| 3,681,118 A * | 8/1972 | Tsuyoshi et al. | ..... | C23C 2/20 427/349 |
| 3,736,174 A * | 5/1973 | Moyer | ..... | B21B 45/0278 427/349 |
| 3,932,683 A | 1/1976 | Robins et al. | | |

FOREIGN PATENT DOCUMENTS

| | | | | |
|---|---|---|---|---|
| JP | S5521564 A | 2/1980 | | |
| JP | S60258458 A | 12/1985 | | |
| JP | H06184717 A | 7/1994 | | |
| JP | 2001279415 A | 10/2001 | | |
| JP | 2004027263 A | 1/2004 | | |
| JP | 2010215929 A | 9/2010 | | |
| JP | 2011068951 A | 4/2011 | | |
| JP | 2014055307 A | 3/2014 | | |
| WO | 2016056178 A1 | 4/2016 | | |
| WO | WO-2016056178 A1 * | 4/2016 | ..... | C23C 2/06 |

OTHER PUBLICATIONS

Jul. 11, 2017, International Search Report issued in the International Patent Application No. PCT/JP2017/020142.
Jun. 12, 2018, Notification of Reasons for Refusal issued by the Japan Patent Office in the corresponding Japanese Application No. 2018-100409 with English language Concise Statement of Relevance Patent.
Jun. 18, 2020, Office Action issued by the IP Australia in the corresponding Australian Patent Application No. 2017296667.
Mar. 8, 2019, the Extended European Search Report issued by the European Patent Office in the corresponding European Patent Application No. 17827265.4.
Apr. 1, 2020, Communication pursuant to Article 94(3) EPC issued by the European Patent Office in the corresponding European Patent Application No. 17827265.4.
Jun. 19, 2019, Office Action issued by the IP Australia in the corresponding Australian Patent Application No. 2017296667.
Jan. 20, 2020, Office Action issued by the IP Australia in the corresponding Australian Patent Application No. 2017296667.
Aug. 21, 2020, Office Action issued by the Korean Intellectual Property Office in the corresponding Korean Patent Application No. 10-2019-7002523 with English language concise statement of relevance.
Dec. 15, 2020, Office Action issued by the China National Intellectual Property Administration in the rresponding Chinese Patent Application No. 201780042945.1 with English language concise statement of relevance.
Feb. 5, 2021, Office Action issued by the Korean Intellectual Property Office in the corresponding Korean Patent Application No. 10-2019-7002523 with English language concise statement of relevance.
Apr. 6, 2021, Office Action issued by the the IP Australia in the corresponding Australian Patent Application No. 2020204123.
Apr. 13, 2021, Office Action issued by the Korean Intellectual Property Office in the corresponding Korean Patent Application No. 10-2019-7002523 with English language concise statement of relevance.
Jun. 2, 2021, Office Action issued by the China National Intellectual Property Administration in the corresponding Chinese Patent Application No. 201780042945.1 with English language concise statement of relevance.

* cited by examiner

METHOD OF PRODUCING HOT-DIP METAL COATED STEEL STRIP AND CONTINUOUS HOT-DIP METAL COATING APPARATUS

TECHNICAL FIELD

The present disclosure relates to a method of producing a hot-dip metal coated steel strip and a continuous hot-dip metal coating apparatus, and in particular, to gas wiping for adjusting the amount of molten metal adhered to the surfaces of a steel strip (hereinafter also referred to as "coating weight").

BACKGROUND

In a continuous hot-dip metal coating line, as illustrated in FIG. 2, a steel strip S annealed in a continuous annealing furnace in a reducing atmosphere passes through a snout 10 and continuously flows into a molten metal bath 14 in a coating bath 12. Then, the steel strip S is pulled up above the molten metal bath 14 through sink rolls 16 and support rolls 18 in the molten metal bath 14, adjusted to a predetermined coating thickness with gas wiping nozzles 20A and 20B, then cooled, and led to a later process. The gas wiping nozzles 20A and 20B are arranged above the coating bath 12 so as to oppose each other across the steel strip S, and gas is blown toward the both sides of the steel strip S from the gas injection ports. Through this gas wiping, excess molten metal is scraped off, the coating weight on the surface of the steel strip is adjusted, and the molten metal adhering to the surface of the steel strip is made uniform in the transverse direction and the longitudinal direction of the steel strip. The gas wiping nozzles 20A and 20B are generally configured to be wider than the steel strip width in order to cope with various steel strip widths, positional deviation in the transverse direction at the time of pulling up the steel strip, and so on, and to extend further outward than the widthwise ends of the steel strip.

In such gas wiping method, due to one or both of (1) oscillation caused by impact pressure of the wiping gas and (2) viscosity unevenness caused by oxidation/cooling of the molten metal, a wavy flow pattern called bath wrinkles (saggings) is likely to occur on the coating surface of the hot-dip metal coated steel strip produced. A coated steel sheet with such bath wrinkles inhibit the surface condition of the coating film, particularly smoothness, when the coating surface is used as the coating base surface in the use of an exterior plate. Thus, coated steel sheets with bath wrinkles can not be used for exterior plates requiring a coating process with excellent appearance, which greatly affects the yield of coated steel sheets.

The following method is known as a method for suppressing coating surface defects, bath wrinkles. JP2004-27263A (PTL 1) describes a method for making bath wrinkles inconspicuous by changing the surface characteristics of temper rolling rolls and the rolling conditions during temper rolling which is a post-coating process. JPS55-21564A (PTL 2) describes a method whereby prior to introducing a steel sheet into a hot-dip galvanizing bath, the surface roughness of the steel sheet is adjusted according to the coating weight using a skin pass mill, a tension leveler, and the like to suppress generation of bath wrinkles.

CITATION LIST

Patent Literature

PTL 1: JP2004-27263A
PTL 2: JPS55-21564A

SUMMARY

Technical Problem

However, according to the study made by the inventors of the present disclosure, the method of PTL 1 only reduces minor bath wrinkles, but has no effect on severe bath wrinkles. Further, according to the method of Patent Document 2, there is a cost problem due to the necessity of installing a skin pass mill, a tension leveler, and the like upstream of the hot-dip galvanizing bath. Even when these are installed, it is considered difficult to obtain ideal surface roughness due to the chemical and physical change of the galvanizing film accompanying pickling and recrystallization in the pretreatment apparatus and the annealing furnace, and to suppress the occurrence of bath wrinkles sufficiently.

It would thus be helpful to provide a method of producing a hot-dip metal coated steel strip and a continuous hot-dip metal coating apparatus capable of sufficiently suppressing generation of bath wrinkles and producing high-quality hot-dip metal coated steel strip at low cost.

Solution to Problem

In view of the above, the inventors focused attention on the installation angle of the gas wiping nozzle. Normally, gas wiping nozzles are installed such that the gas injection direction is substantially perpendicular (that is, horizontal direction) with respect to the steel strip. In this respect, the inventors discovered that the occurrence of bath wrinkles can be sufficiently suppressed by installing gas wiping nozzles at an angle such that the gas injection direction is downward by a predetermined angle or more with respect to the horizontal direction.

The present disclosure was completed based on the above discoveries, and the primary features thereof are as follows.

(1) A method of producing a hot-dip metal coated steel strip, comprising: continuously dipping a steel strip in a molten metal bath; and blowing a gas from a pair of gas wiping nozzles arranged with the steel strip therebetween to the steel strip while being pulled up from the molten metal bath so as to adjust a coating weight of molten metal on both sides of the steel strip to thereby continuously produce a hot-dip metal coated steel strip, wherein each of the gas wiping nozzles comprises an injection port portion that is installed downward with respect to a horizontal plane such that an angle θ formed between the injection port portion and the horizontal plane is 10° or more and 75° or less, and has a header pressure P below 30 kPa.

(2) The method of producing a hot-dip metal coated steel strip according to (1), wherein the molten metal comprises a chemical composition containing (consisting of) Al: 1.0 mass % to 10 mass %, Mg: 0.2 mass % to 1 mass %, and Ni: 0 mass % to 0.1 mass %, with the balance being Zn and inevitable impurities.

(3) The method of producing a hot-dip metal coated steel strip according to (1) or (2), wherein a temperature T (° C.) of the gas immediately after discharged from a tip of each of the gas wiping nozzles is controlled to satisfy $T_M-150 \leq T \leq T_M+250$ in relation to a melting point $T_M$ (° C.) of the molten metal.

(4) The method of producing a hot-dip metal coated steel strip according to any one of (1) to (3), wherein the gas is an inert gas.

(5) A continuous hot-dip metal coating apparatus comprising: a coating bath configured to contain molten metal and to form a molten metal bath; and a pair of gas wiping nozzles arranged with a steel strip therebetween, and configured to blow a gas toward the steel strip to adjust a coating weight on both sides of the steel strip, the steel strip being continuously pulled up from the molten metal bath, wherein each of the gas wiping nozzles comprises an injection port portion that is installed downward with respect to a horizontal plane such that an angle θ formed between the injection port portion and the horizontal plane is 10° or more and 75° or less, and has a header pressure P that is set below 30 kPa.

(6) The continuous hot-dip metal coating apparatus according to (5), further comprising: a memory in which a relation between the header pressure P and a suitable angle θ is recorded in a range where the header pressure P is below 30 kPa; an angle detector configured to detect the angle θ; a nozzle driver configured to change the angle θ; and a controller for the nozzle driving device, wherein the controller is configured to read from the memory a suitable angle θ corresponding to the pressure P after being changed in response to a change in operation conditions, and configured to, when a detection angle detected by the angle detector does not satisfy the suitable angle θ, control the nozzle driver to set the detection angle to the suitable angle θ.

(7) The continuous hot-dip metal coating apparatus according to (5), further comprising: a surface appearance detector configured to observe surface appearance of the steel strip after wiping; a nozzle driver configured to change the angle θ; and a controller for the nozzle driver, wherein the controller is configured to control the nozzle driver based on an output from the surface appearance detector to finely adjust the angle θ.

Advantageous Effect

According to the method of producing a hot-dip metal coated steel strip and the continuous hot-dip metal coating apparatus disclosed herein, generation of bath wrinkles can be sufficiently suppressed, and a high-quality hot-dip metal coated steel strip can be produced at low cost.

DETAILED DESCRIPTION

Figure 1:
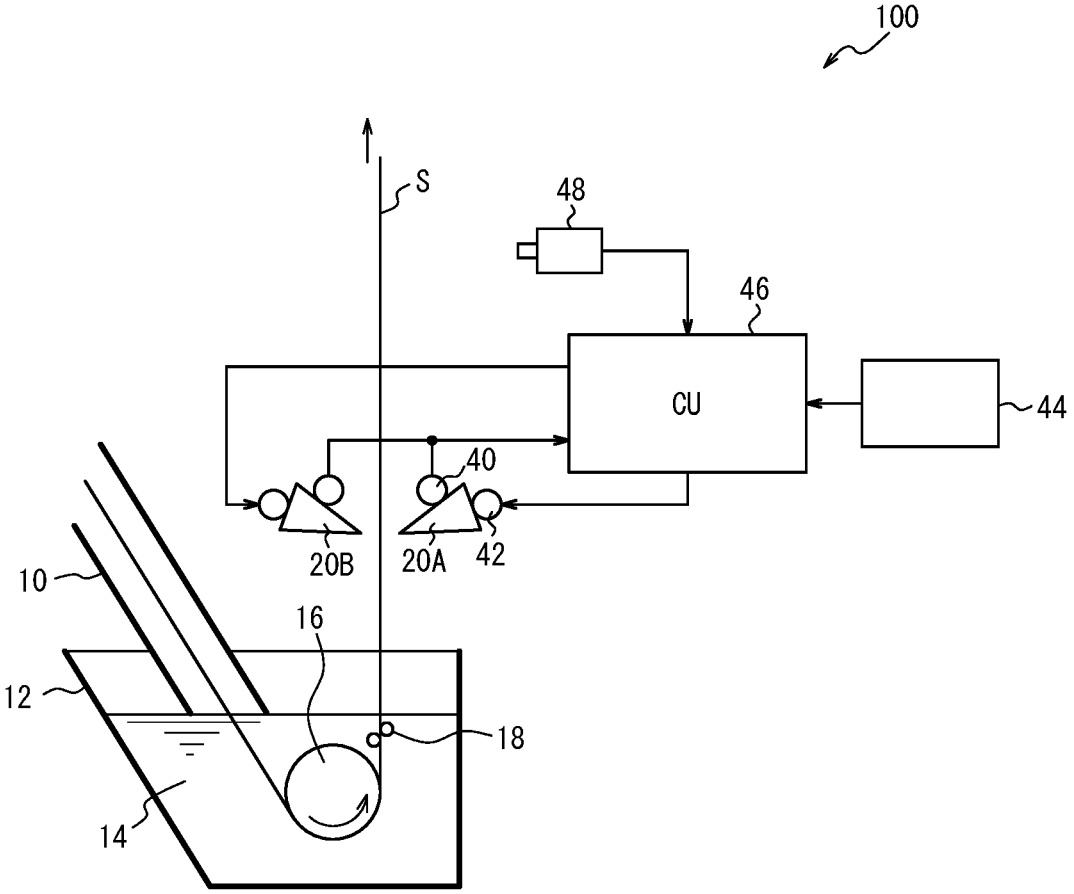
FIG. 1 is a schematic view illustrating a configuration of a continuous hot-dip metal coating apparatus 100 according to an embodiment of the present disclosure.
Figure 2:
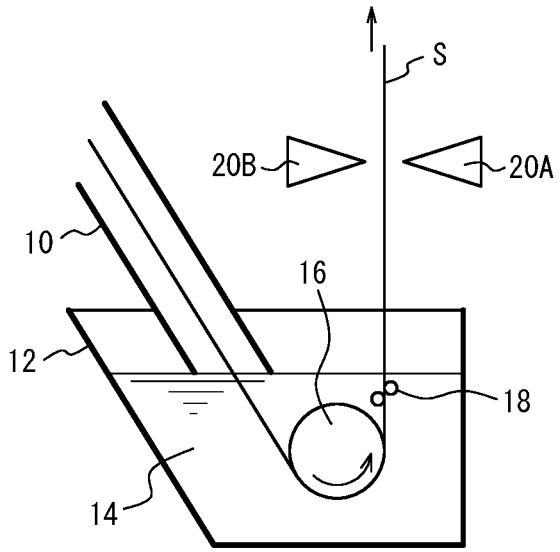
FIG. 2 is a schematic view illustrating a configuration of a conventional continuous hot-dip metal coating apparatus.

Referring to FIG. 1, a method of producing a hot-dip metal coated steel strip and a continuous hot-dip metal coating apparatus 100 (hereinafter also simply referred to as "coating apparatus") according to an embodiment of the present disclosure will be described.

Referring to FIG. 1, a coating apparatus 100 according to this embodiment has a snout 10, a coating bath 12 configured to contain molten metal, sink rolls 16, and support rolls 18. The snout 10 is a member having a rectangular cross section perpendicular to the traveling direction of a steel strip that defines the space through which the steel strip S passes and its tip is dipped in a molten metal bath 14 formed in a coating bath 12. In one embodiment, the steel strip S annealed in a continuous annealing furnace in a reducing atmosphere passes through the snout 10 and is continuously introduced into the molten metal bath 14 in the coating bath 12. Then, the steel strip S is pulled up above the molten metal bath 14 through sink rolls 16 and support rolls 18 in the molten metal bath 14, adjusted to a predetermined coating thickness with a pair of gas wiping nozzles 20A and 20B, then cooled, and led to a later process.

Figure 3A:
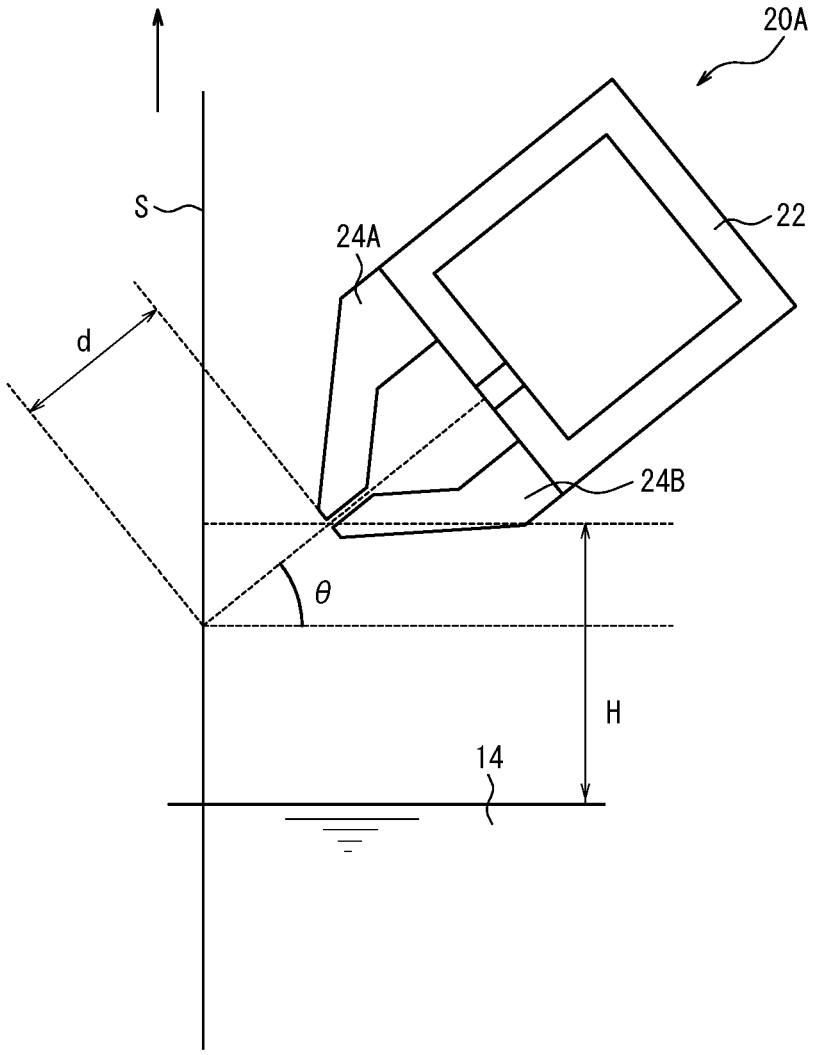
FIGS. 3A and 3B are cross-sectional views perpendicular to a steel strip S of a gas wiping nozzle 20A according to an embodiment of the present disclosure.
Figure 3B:
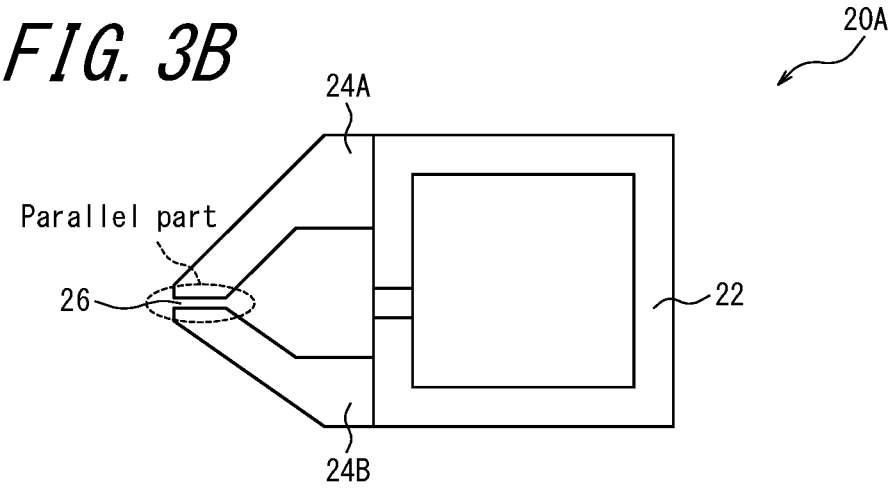

Referring now to FIGS. 3A and 3B in addition to FIG. 1, a pair of gas wiping nozzles 20A and 20B (hereinafter also simply referred to as "nozzles") are arranged above the coating bath 12 so as to oppose each other across the steel strip S. The nozzle 20A blows a gas toward the steel strip S from an injection port 26 (nozzle slit) extending in the transverse direction of the steel strip at the tip thereof, and adjusts the coating weight on the surface of the steel strip. The same is true for the other nozzle 20B. Excess molten metal is scraped off by the pair of nozzles 20A and 20B such that the coating weight on both sides of the steel strip S is adjusted and made uniform in the transverse direction and the longitudinal direction of the steel strip S.

The gas wiping nozzle 20A is generally configured to be wider than the steel strip width in order to cope with various steel strip widths, positional deviation in the transverse direction at the time of pulling up the steel strip, and so on, and to extend further outward than the widthwise ends of the steel strip. As illustrated in FIG. 3B, the nozzle 20A comprises a nozzle header 22 and upper and lower nozzle members 24A and 24B connected to the nozzle header 22. The tip portions of the upper and lower nozzle members 24A and 24B are opposed to each other in parallel in a cross-sectional view perpendicular to the steel strip S to form a gas injection port (nozzle slit) 26 (see "Parallel part" in FIG. 3B). The injection port 26 extends in the transverse direction of the steel strip S. The vertical sectional shape of the nozzle 20A has a tapered shape that tapers toward the tip. The thickness of the tip portion of the upper and lower nozzle members 24A and 24B may be about 1 mm to 3 mm. Further, although the opening width (nozzle gap) of the injection port is not particularly limited, it can be set to about 0.5 mm to 3.0 mm. A gas supplied from a gas supply mechanism (not illustrated) passes through the interior of the header 22, further passes through a gas flow path defined by the upper and lower nozzle members 24A and 24B, is injected from the injection port 26, and blown onto the surface of the steel strip S. The other nozzle 20B has the same configuration.

The method of producing a hot-dip metal coated steel strip of this embodiment comprises: continuously dipping a steel strip in the molten metal bath 14; and blowing a gas from a pair of gas wiping nozzles 20A and 20B arranged with the steel strip S therebetween to the steel strip S while being pulled up from the molten metal bath 14 so as to adjust the amount of molten metal adhering to both sides of the steel strip S to thereby continuously produce a hot-dip metal coated steel strip.

One cause of generation of bath wrinkles described above is the generation of initial irregularities at the point where the wiping gas collides with the molten metal surface (stagnation point). The generation of initial irregularities is considered to be caused by the molten metal irregularly flowing on the steel strip as a result of one or both of (1) swing of the wiping gas collision pressure and (2) viscosity unevenness due to oxidation/cooling of the molten metal. Therefore, suppression of the phenomena of (1) and/or (2) is considered to lead to reduction of bath wrinkles.

From this viewpoint, in the present disclosure, it is important that the gas wiping nozzles 20A and 20B are installed downward with respect to the horizontal plane such that the angle θ formed between the injection port portion and the horizontal plane is 10° or more. By setting the angle θ to 10° or more, generation of bath wrinkles can be sufficiently suppressed. On the other hand, when the angle θ exceeds 75°, occurrence of bath wrinkles can not be suppressed due to an unstable pressure accumulation to be described later. Therefore, the angle θ is set to 75° or less. As used herein, the phrase "the angle θ formed between the injection port portion and the horizontal plane" means the angle formed by, when viewed in a cross section perpendicular to the steel strip, the horizontal plane and the extending direction of the parallel part, which is a part where the upper and lower nozzle members 24A and 24B are opposed to each other so as to form a slit.

In the present disclosure, the header pressure P of the wiping nozzles is set below 30 kPa. This is because if the header pressure P is set to 30 kPa or more, the wind speed when the wiping gas collides with the bath surface becomes fast, and bath splashing frequently occurs. When the target coating weight is high, the header pressure P is decreased, yet in that case, the above-described bath wrinkles easily occur. In contrast, by setting the angle θ of the gas wiping nozzles as described above, even when the header pressure P is as low as below 30 kPa, the occurrence of bath wrinkles can be sufficiently suppressed. When the header pressure P is below 10 kPa, in particular, the collision pressure at the edges of the steel strip becomes weak, and thus the coating weight at the edges becomes too large, possibly resulting in a non-uniform coating weight in the transverse direction of the steel strip. Therefore, the header pressure P is preferably 10 kPa or more.

In the present disclosure, by controlling the angle θ of the wiping nozzles in this manner, the range of the collision pressure acting on the steel strip S is widened, and the occurrence of bath wrinkles is suppressed. Since the wiping nozzles are normally installed such that the gas injection direction is substantially perpendicular to the steel strip S, the collision pressure increases. Accordingly, measurement was made of the collision pressure under the condition that bath wrinkles were generated, and it was found that the collision pressure swings with time. One cause of this is considered to be that especially in the case of low gas pressure, the potential core did not sufficiently develop at the parallel portion inside the nozzles (see FIG. 3B), and was disturbed by the outside air when blown out from the nozzles.

In the case where the collision pressure swings, if the collision pressure acts locally, the swing directly leads to unevenness of the coating weight. On the other hand, even if the collision pressure swings, when the range of action is wide, irregularities of the liquid film caused by the swing overlap, and unevenness of the coating weight will be less likely to occur. As a simple method to expand the range of action of the collision pressure, a method of controlling the angle θ of the wiping nozzles was implemented.

Figure 4:
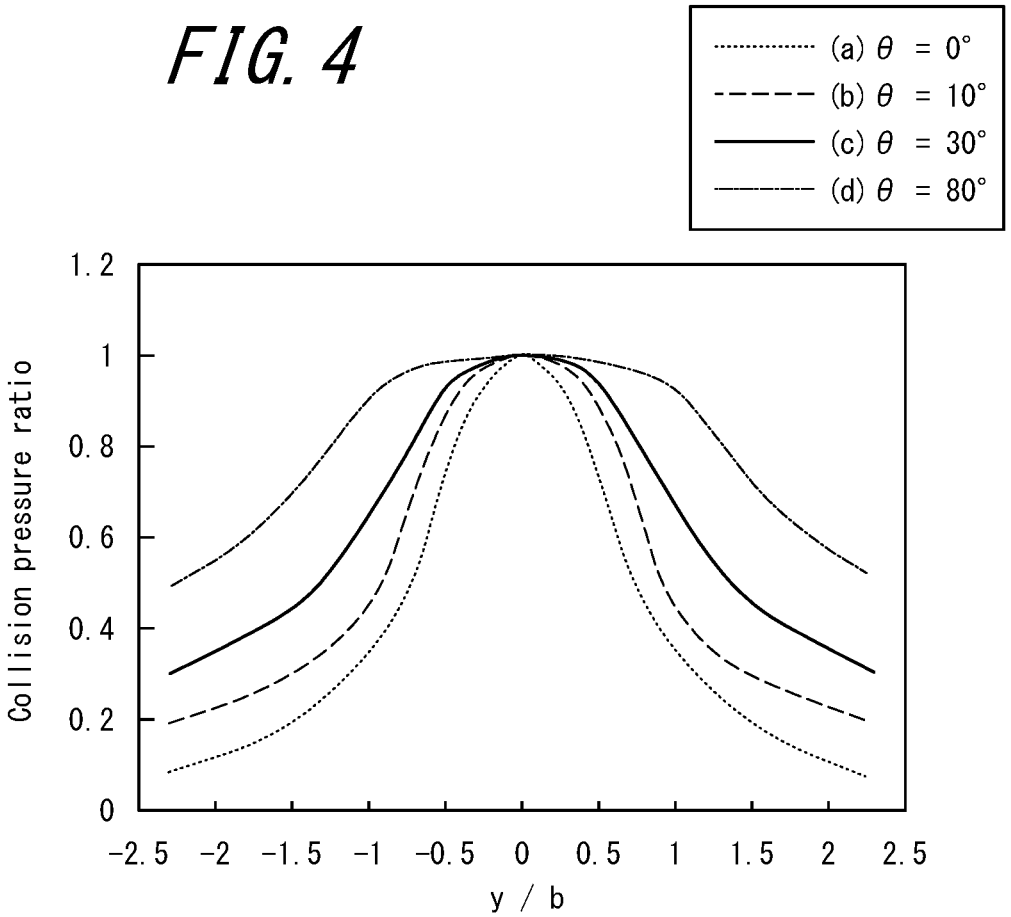
FIG. 4 is a graph illustrating collision pressure distribution curves at various nozzle angles θ.

Wiping was performed while changing the angle θ, and the surface appearance after wiping was inspected. Bath wrinkle defects occurred at θ=0°, while improvement tendency was observed at θ=10° or more. FIG. 4 compares the distribution curves of impact pressures measured under the conditions of θ=0°, 10°, 30°, and 80°. In FIG. 4, (a) indicates the collision pressure distribution curve where θ=0°, (b) indicates the collision pressure distribution curve where θ=10°, (c) indicates the collision pressure distribution curve where θ=30°, and (d) indicates the collision pressure distribution curve where θ=80°. In FIG. 4, b denotes the opening width (nozzle gap) of the nozzle slit, y denotes the vertical distance from the gas jet center (y=0), and y/b on the horizontal axis represents the ratio of both. y<0 means the side below the gas jet center (on the hot-dip coating bath side) and y>0 means the side above the gas jet center (on a side opposite to the hot-dip coating bath side). The collision pressure ratio on the vertical axis represents the ratio of the collision pressure under other conditions with respect to the reference (1.0) in the case where the reference is the maximum pressure of the collision pressure distribution curve at the set nozzle angle θ. As used herein, "gas jet center" means the vertical center of the vertical range over which gas collides with the steel strip.

As illustrated in FIG. 4, in the collision pressure distribution at θ=10° in (b), the full width at half maximum (FWHM) of the collision pressure ratio is 1.2 times wider than that in the collision pressure distribution at θ=0° in (a), indicating that wiping is done in a wider range. In the collision pressure distribution at θ=30° in (c), the full width at half maximum of the collision pressure ratio is even wider than that in the collision pressure distribution at θ=10° in (b). It is thus considered that by setting the angle θ to an appropriate range and performing wiping with a wider full width at half maximum, the influence of swing of the collision pressure was suppressed and the effect of suppressing bath wrinkles was obtained.

Figure 5:
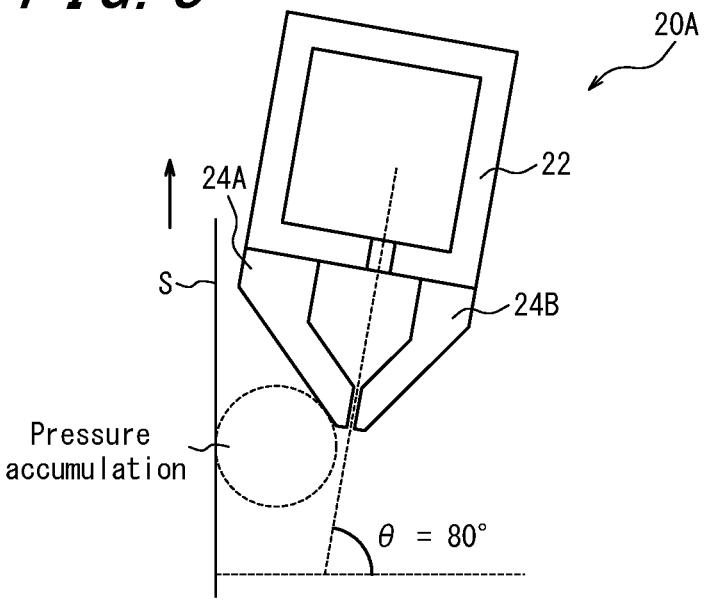
FIG. 5 is a cross-sectional view perpendicular to the steel strip S of the gas wiping nozzle 20A, illustrating a case where the nozzle angle θ is 80°.

On the other hand, at θ=80° where the angle was further increased, the full width at half maximum of the collision pressure distribution (d) was still more gentle and broader than that in (b), but the appearance of the steel strip after coating deteriorated again. Presumably, the reason why the external appearance deteriorated at this time is that when the angle θ of the wiping nozzles is increased with the distance d between the tip of each wiping nozzle and the steel strip kept constant, the gap between the upper portion of each wiping nozzle and the steel strip S becomes extremely narrow such that the wiping gas is not properly discharged from the gap, resulting in an unstable pressure accumulation (see FIG. 5). Accordingly, above a certain angle, it is considered that the influence of the generated pressure accumulation becomes stronger than the effect of increasing the full width at half maximum of the collision pressure distribution, and the appearance gradually deteriorates. Further, in response to the angle θ being increased, when the distance between each wiping nozzle and the steel strip S becomes smaller and when the steel strip S vibrates, there is a risk of the steel strip coming into contact with a wiping nozzle. In view of the above, the angle θ is set to 75° or less.

Further, regarding the upper limit of the angle θ, it is preferably set as follows in relation to the header pressure P from the viewpoint of more effectively suppressing generation of bath wrinkles. That is, θ≤75° is preferable when the header pressure P is 0 kPa to 10 kPa, θ≤60° is preferable when the header pressure P is more than 10 kPa and 20 kPa or less, and $\theta \leq 50°$ is preferable when the header pressure P is more than 20 kPa and 30 kPa or less.

In addition, the temperature T (° C.) of the gas immediately after discharged from the tip of each gas wiping nozzle is preferably controlled to satisfy $T_M-150 \leq T \leq T_M+250$ in relation to a melting point $T_M$ (° C.) of the molten metal. When the gas temperature T is controlled within the above range, cooling and solidification of the molten metal can be suppressed, and thus viscosity unevenness hardly occurs and generation of bath wrinkles can be suppressed. On the other hand, if the gas temperature T is below $T_M$-150° C. and is too low, it does not affect the flowability of the molten metal, and it is not effective in suppressing the generation of bath wrinkles. Also, if the temperature of the wiping gas is $T_M$+250° C. and is too high, alloying is promoted and the appearance of the steel sheet deteriorates.

The gas injected from the nozzles 20A and 20B is preferably an inert gas. By using an inert gas, it is possible to prevent the oxidation of the molten metal on the surface of the steel strip, and thus to further suppress viscosity unevenness of the molten metal. Examples of the inert gas include, but are not limited to, nitrogen, argon, helium, and carbon dioxide.

In this embodiment, it is preferable that the molten metal comprises a chemical composition containing Al: 1.0 mass % to 10 mass %, Mg: 0.2 mass % to 1 mass %, and Ni: 0 mass % to 0.1 mass %, with the balance being Zn and inevitable impurities. It is confirmed that if Mg is contained in this manner, viscosity unevenness due to oxidation/cooling of the molten metal is likely to occur, and so are bath wrinkles. Thus, when the molten metal has the above chemical composition, the effect of suppressing bath wrinkles according to the present disclosure is remarkably exhibited. In addition, in the case where the composition of the molten metal is 5 mass % Al—Zn or 55 mass % Al—Zn, the effect of suppressing bath wrinkles according to the present disclosure can be obtained.

Examples of the hot-dip metal coated steel strip produced by the production method and the coating apparatus disclosed herein include hot-dip galvanized steel sheets, including both galvanized steel sheets (GI) not subjected to alloying treatment after hot-dip galvanizing, and galvanized steel sheets (GA) subjected to alloying treatment after hot-dip galvanizing.

In this embodiment, control is preferably provided such that the angle θ is set within the above range and finely adjusted.

As a first control example, the angle θ of the wiping nozzles is controlled to be in a more preferable range or a more preferable value within the range of 10° to 75° according to the value of the header pressure P of the gas wiping nozzles. As described above, the preferable range of the angle θ of the wiping nozzles within the range of 10° to 75° changes according to the value of the header pressure P. Thus, by adjusting the angle θ as described below, suppression of bath wrinkles can be more reliably and sufficiently achieved.

Referring to FIG. 1, an angle detector 40 is a device that is configured to detect the angle θ of the nozzles 20A and 20B, and is adjusted such that it displays 0 degree when the nozzles 20A and 20B are parallel to the bath surface. Examples of the angle detector 40 include, but are not limited to, a physical detector such as a protractor, a detector using a laser, and a detector applying electric characteristics of a special liquid. A nozzle driver 42 is provided with a nozzle rotating motor and can change the angle θ. A memory 44 stores information on a correspondence table between the header pressure P and the nozzle angle θ, that is, the range of the suitable nozzle angle θ corresponding to the header pressure P. For example, as described above, the memory 44 stores a correspondence table that establishes the relationship such that the angle θ is set to 10° to 75° when the header pressure P is 0 kPa to 10 kPa, the angle θ is set to 10° to 60° when the header pressure P is more than 10 kPa to 20 kPa or less, and the angle θ is set to 10° to 50° when the header pressure P is more than 20 kPa to 30 kPa or less.

The header pressure P can be appropriately determined according to the operation conditions such as the line speed, the thickness of the steel strip, the target coating weight, the distance between the tip of each wiping nozzle and the steel strip, and the like. Therefore, upon operation under predetermined operation conditions or when changing operation conditions, the controller 46 reads a suitable angle θ (a suitable range or a target value) corresponding to the determined header pressure P from the memory 44. The controller 46 determines the necessary angle change amount from the angle θ read from the memory 44 and the output value of the angle detector 40 and controls the nozzle driver 42. The nozzle driver 42 rotates the nozzles 20A and 20B to a predetermined angle according to the output value of the controller 46. Specifically, the controller 46 is configured to read from the memory 44 a suitable angle θ corresponding to the pressure P after being changed in response to a change in operation conditions, and configured to, when a detection angle detected by the angle detector 40 does not satisfy the suitable angle θ, control the nozzle driver 42 to set the detection angle to the suitable angle θ.

As a second control example, the appearance of the steel strip surface after wiping is observed, and the angle θ is finely adjusted based on the result. Referring to FIG. 1, a surface appearance detector 48 is a device that is configured to detect the appearance of the surface of the steel strip after passing between the gas wiping nozzles, for example, arithmetic mean waviness Wa, and is provided, for example, above the gas wiping nozzle 20A. The surface appearance detector 48 continuously produces images of the surface of the steel strip after passing between the gas wiping nozzles, and inputs the information to the controller 46. The type of the surface appearance detector 48 may be a non-contact 3D roughness meter using a laser, yet it is not particularly limited. Based on the output of the surface appearance detector 48, the controller 46 controls the nozzle drivers 42 to finely adjust the angle θ. Specifically, the following control is performed.

The surface appearance of the steel strip is judged according to the following criteria.

"Very Poor": failed=
- a galvanized steel sheet in which a large amount of splash defects are observed ($0<Wa$, $1.30 \leq S$)

"Poor": failed=
- a galvanized steel sheet in which large bath wrinkles can be recognized by visual inspection ($1.50<Wa$, $S<1.30$)

"Unsatisfactory": failed=
- a galvanized steel sheet in which small bath wrinkles can be recognized by visual inspection ($1.00<Wa \leq 1.50$, $S<1.30$)

"Good": passed=
- a galvanized steel sheet with good surface quality in which bath wrinkles can not be recognized by visual inspection ($0.50<Wa \leq 1.00$, $S<1.30$)

"Excellent": passed=
- a galvanized steel sheet with very good surface quality in which bath wrinkles can not be recognized by visual inspection ($0<Wa \leq 0.50$, $S<1.30$)

Wa is a value of the arithmetic mean waviness Wa (μm) measured in accordance with the standard of JIS B0601-2001. The splash inclusion ratio S is the ratio [%] of a steel strip length determined to have splash defects in the inspection process to a steel strip length passed under each production condition.

When Wa measured by the detector is 0.50<Wa≤1.00 (that is, passed, judged "Good"), fine adjustment is made to increase the wiping nozzle angle θ such that Wa to be measured satisfies 0<Wa≤0.50 (that is, passed, judged "Excellent"). This is because when the wiping nozzle angle θ is increased, the swing of the collision pressure of the wiping gas further decreases.

It is desirable that the surface appearance detector 48 performs measurement at a position where the steel strip S passes between the wiping nozzles and where the molten metal on the steel strip surface solidifies. Otherwise, at a position directly above the wiping nozzle, the molten metal is not solidified, and the measured arithmetic mean waviness Wa varies. Therefore, a desirable position is a position at which the molten metal on the surface of the steel strip solidifies, for example, a position 40 m or more on the downstream side of the wiping nozzles. Note that the measurement position is desirably immediately after solidification of the molten metal lest the responsiveness should deteriorate. Therefore, for example, a desirable measurement position is 70 m or less on the downstream side of the wiping nozzles.

If the nozzle height H is too low, a large amount of splashing occurs on the bath surface. Thus, the nozzle height is desirably 200 mm or more. In FIG. 3A, the nozzle height H and the distance d between the tip of each gas wiping nozzle and the steel strip are not necessarily linked with the wiping nozzle angle θ, yet they are preferably changed as appropriate depending on the target coating weight and the amount of splashing on the bath surface.

Examples

In a production line of hot-dip galvanized steel strips, production test of hot-dip galvanized steel strips was conducted. In each example and comparative example, the coating apparatus illustrated in FIG. 1 was used. A gas wiping nozzle having a nozzle gap of 1.2 mm was used. For each example and comparative example, the composition of the coating bath, the temperature T of the coating bath, the melting point $T_M$ of the coating bath, the nozzle angle θ, the wiping gas pressure P, the gas type, and the temperature T of the wiping gas were listed in Table 1. The distance d between the nozzle tip and the steel strip was 15 mm. The height H of each nozzle from the bath surface was 350 mm.

As a method of supplying a gas to the gas wiping nozzles, a method of supplying a gas pressurized to a predetermined pressure with a compressor was adopted. In this way, each hot-dip galvanized steel strip was produced by passing a steel strip having a thickness of 1.2 mm and a width of 1000 mm at a steel strip speed L (line speed) of 2 m/s.

Also, the appearance of each hot-dip galvanized steel strip produced and the total coating weight on both sides were evaluated. Regarding the appearance evaluation of the steel sheet, judgment was made based on the following criteria. The results are listed in Table 1.

"Very Poor": failed=
- a galvanized steel sheet in which a large amount of splash defects are observed (0<Wa, 1.30≤S)

"Poor": failed=
- a galvanized steel sheet in which large bath wrinkles can be recognized by visual inspection (1.50<Wa, S<1.30)

"Unsatisfactory": failed=
- a galvanized steel sheet in which small bath wrinkles can be recognized by visual inspection (1.00<Wa≤1.50, S<1.30)

"Good": passed=
- a galvanized steel sheet with good surface quality in which bath wrinkles can not be recognized by visual inspection (0.50<Wa≤1.00, S<1.30)

"Excellent": passed=
- a galvanized steel sheet with very good surface quality in which bath wrinkles can not be recognized by visual inspection (0<Wa≤0.50, S<1.30)

Wa is a value of the arithmetic mean waviness Wa (μm) measured based on the standard of JIS B0601-2001. The splash inclusion ratio S is the ratio [%] of a steel strip length determined to have splash defects in the inspection process to a steel strip length passed under each production condition.

TABLE 1

| No. | Category | Coating type | Coating bath composition [%] Al | Mg | Ni | Si | Zn | T [° C.] | $T_M$ [° C.] | Nozzle angle θ [°] | Gas pressure P [kPa] |
|---|---|---|---|---|---|---|---|---|---|---|---|
| 1 | Comparative example | A | 0.2 | 0 | 0 | 0 | Balance | 460 | 420 | 0 | 14 |
| 2 | Example | | | | | | | | | 10 | 14 |
| 3 | Example | | | | | | | | | 30 | 14 |
| 4 | Example | | | | | | | | | 75 | 14 |
| 5 | Comparative example | | | | | | | | | 80 | 14 |
| 6 | Comparative example | | | | | | | | | 30 | 30 |
| 7 | Example | | | | | | | | | 30 | 14 |
| 8 | Comparative example | B | 4.5 | 0.5 | 0.05 | 0 | Balance | 450 | 375 | 0 | 14 |
| 9 | Example | | | | | | | | | 10 | 14 |
| 10 | Example | | | | | | | | | 30 | 14 |
| 11 | Example | | | | | | | | | 75 | 14 |
| 12 | Comparative example | | | | | | | | | 80 | 14 |
| 13 | Comparative example | | | | | | | | | 30 | 30 |
| 14 | Example | | | | | | | | | 30 | 14 |
| 15 | Example | | | | | | | | | 30 | 14 |
| 16 | Example | | | | | | | | | 30 | 14 |
| 17 | Example | | | | | | | | | 30 | 14 |
| 18 | Comparative example | C | 5 | 0 | 0 | 0 | Balance | 450 | 375 | 0 | 14 |
| 19 | Example | | | | | | | | | 10 | 14 |
| 20 | Example | | | | | | | | | 30 | 14 |

TABLE 1-continued

| | | | | | | | | | | | |
|---|---|---|---|---|---|---|---|---|---|---|---|
| 21 | Example | | | | | | | | | 75 | 14 |
| 22 | Comparative example | | | | | | | | | 80 | 14 |
| 23 | Comparative example | | | | | | | | | 30 | 30 |
| 24 | Example | | | | | | | | | 30 | 14 |
| 25 | Comparative example | D | 55 | 0 | 0 | 1.6 | Balance | 610 | 570 | 0 | 14 |
| 26 | Example | | | | | | | | | 10 | 14 |
| 27 | Example | | | | | | | | | 30 | 14 |
| 28 | Example | | | | | | | | | 75 | 14 |
| 29 | Comparative example | | | | | | | | | 80 | 14 |
| 30 | Comparative example | | | | | | | | | 30 | 30 |
| 31 | Example | | | | | | | | | 30 | 14 |
| 32 | Comparative example | E | 5 | 0.9 | 0 | 0 | Balance | 450 | 375 | 0 | 14 |
| 33 | Example | | | | | | | | | 10 | 14 |
| 34 | Example | | | | | | | | | 30 | 14 |
| 35 | Example | | | | | | | | | 75 | 14 |
| 36 | Comparative example | | | | | | | | | 80 | 14 |
| 37 | Comparative example | | | | | | | | | 30 | 30 |
| 38 | Example | | | | | | | | | 30 | 14 |
| 39 | Comparative example | F | 4.9 | 0.6 | 0.09 | 0 | Balance | 450 | 375 | 0 | 14 |
| 40 | Example | | | | | | | | | 10 | 14 |
| 41 | Example | | | | | | | | | 30 | 14 |
| 42 | Example | | | | | | | | | 75 | 14 |
| 43 | Comparative example | | | | | | | | | 80 | 14 |
| 44 | Comparative example | | | | | | | | | 30 | 30 |
| 45 | Example | | | | | | | | | 30 | 14 |

| No. | Category | Gas type | Gas temp. [° C.] | Coating weight [g/m$^2$] | Wa [μm] | Splash inclusion ratio S [%] | Surface appearance |
|---|---|---|---|---|---|---|---|
| 1 | Comparative example | Air | 100 | 128 | 2.18 | 0.23 | Poor |
| 2 | Example | Air | 100 | 130 | 1.48 | 0.35 | Unsatisfactory |
| 3 | Example | Air | 100 | 129 | 0.88 | 0.41 | Good |
| 4 | Example | Air | 100 | 130 | 1.26 | 0.31 | Unsatisfactory |
| 5 | Comparative example | Air | 100 | 133 | 1.57 | 0.29 | Poor |
| 6 | Comparative example | Air | 100 | 78 | 0.76 | 1.83 | Very Poor |
| 7 | Example | Nitrogen | 450 | 140 | 0.79 | 0.27 | Good |
| 8 | Comparative example | Air | 100 | 127 | 4.22 | 0.32 | Poor |
| 9 | Example | Air | 100 | 130 | 0.94 | 0.30 | Good |
| 10 | Example | Air | 100 | 134 | 0.53 | 0.29 | Good |
| 11 | Example | Air | 100 | 133 | 0.85 | 0.33 | Good |
| 12 | Comparative example | Air | 100 | 132 | 1.33 | 0.42 | Unsatisfactory |
| 13 | Comparative example | Air | 100 | 76 | 0.43 | 1.75 | Very Poor |
| 14 | Example | Air | 300 | 127 | 0.33 | 0.38 | Excellent |
| 15 | Example | Air | 630 | 135 | 0.81 | 0.28 | Good |
| 16 | Example | Nitrogen | 100 | 131 | 0.42 | 0.32 | Excellent |
| 17 | Example | Nitrogen | 450 | 133 | 0.12 | 0.29 | Excellent |
| 18 | Comparative example | Air | 100 | 132 | 2.34 | 0.26 | Poor |
| 19 | Example | Air | 100 | 129 | 1.44 | 0.40 | Unsatisfactory |
| 20 | Example | Air | 100 | 131 | 0.92 | 0.37 | Good |
| 21 | Example | Air | 100 | 128 | 1.37 | 0.38 | Unsatisfactory |
| 22 | Comparative example | Air | 100 | 130 | 1.55 | 0.26 | Poor |
| 23 | Comparative example | Air | 100 | 77 | 0.81 | 1.79 | Very Poor |
| 24 | Example | Nitrogen | 450 | 135 | 0.91 | 0.25 | Good |
| 25 | Comparative example | Air | 450 | 131 | 2.43 | 0.34 | Poor |
| 26 | Example | Air | 450 | 129 | 1.46 | 0.29 | Unsatisfactory |
| 27 | Example | Air | 450 | 129 | 0.89 | 0.35 | Good |
| 28 | Example | Air | 450 | 133 | 1.42 | 0.30 | Unsatisfactory |
| 29 | Comparative example | Air | 450 | 130 | 1.63 | 0.40 | Unsatisfactory |
| 30 | Comparative example | Air | 450 | 75 | 0.48 | 1.92 | Very Poor |
| 31 | Example | Nitrogen | 450 | 131 | 0.86 | 0.41 | Good |
| 32 | Comparative example | Air | 100 | 129 | 4.69 | 0.35 | Poor |
| 33 | Example | Air | 100 | 131 | 0.98 | 0.39 | Good |
| 34 | Example | Air | 100 | 128 | 0.51 | 0.27 | Good |
| 35 | Example | Air | 100 | 131 | 0.86 | 0.33 | Good |
| 36 | Comparative example | Air | 100 | 130 | 1.37 | 0.26 | Unsatisfactory |
| 37 | Comparative example | Air | 100 | 75 | 0.45 | 1.88 | Very Poor |
| 38 | Example | Nitrogen | 450 | 135 | 0.23 | 0.28 | Excellent |
| 39 | Comparative example | Air | 100 | 130 | 4.31 | 0.32 | Poor |
| 40 | Example | Air | 100 | 130 | 0.96 | 0.29 | Good |
| 41 | Example | Air | 100 | 127 | 0.49 | 0.32 | Excellent |
| 42 | Example | Air | 100 | 131 | 0.87 | 0.35 | Good |
| 43 | Comparative example | Air | 100 | 132 | 1.42 | 0.41 | Unsatisfactory |
| 44 | Comparative example | Air | 100 | 77 | 0.47 | 1.65 | Very Poor |
| 45 | Example | Nitrogen | 450 | 135 | 0.17 | 0.25 | Excellent |

As can be seen from Table 1, in the case of the nozzle angle θ being 10° to 75° and the wiping gas pressure P being less than 30 kPa, Wa was low and good surface appearance was obtained, whereas in the case of the nozzle angle θ or gas wiping pressure P deviating from the range of the present disclosure, Wa or the splash inclusion ratio S increased. In particular, for the coating type B, E, and F, the effects obtained when the nozzle angle θ and the wiping gas pressure P are within the scope of the present disclosure were remarkably obtained.

INDUSTRIAL APPLICABILITY

According to the method of producing a hot-dip metal coated steel strip and the continuous hot-dip metal coating apparatus disclosed herein, generation of bath wrinkles can be sufficiently suppressed, and a high-quality hot-dip metal coated steel strip can be produced at low cost.

REFERENCE SIGNS LIST

100 continuous hot-dip metal coating apparatus
10 snout
12 coating bath
14 molten metal bath
16 sink roll
18 support roll
20A, 20B gas wiping nozzle
22 nozzle header
24A upper nozzle member
24B lower nozzle member
26 injection port
40 angle detector
42 nozzle driver
44 memory
46 controller
48 surface appearance detector
S steel strip

The invention claimed is:

1. A method of producing a hot-dip metal coated steel strip, comprising:

continuously dipping a steel strip in a molten metal bath, wherein the molten metal comprises a chemical composition containing Al: 1.0 mass % to 10 mass %, Mg: 0.2 mass % to 1 mass %, and Ni: 0 mass % to 0.1 mass %, with the balance being Zn and inevitable impurities;

blowing a gas from a pair of gas wiping nozzles arranged with the steel strip therebetween to the steel strip while being pulled up from the molten metal bath so as to adjust a coating weight of molten metal on both sides of the steel strip to thereby continuously produce the hot-dip metal coated steel strip, wherein each of the gas wiping nozzles comprises an injection port portion that is installed downward with respect to a horizontal plane such that an angle θ formed between the injection port portion and the horizontal plane is 10° or more and 75° or less, and has a header pressure P of less than 30 kPa; and detecting the angle θ formed between the injection port portion and the horizontal plane, wherein each of the gas wiping nozzles is driven to adjust the angle θ according to the header pressure P as to satisfy, $10° \leq \theta \leq 75°$ when the header pressure P is 0 kPa to 10 kPa, $10° \leq \theta \leq 60°$ when the header pressure P is more than 10 kPa and 20 kPa or less, and $10° \leq \theta \leq 50°$ when the header pressure P is more than 20 kPa and 30 kPa or less, and wherein a value of the arithmetic mean waviness Wa (μm) of the surface of the hot-dip metal coated steel strip is 1.00 μm or less.

2. The method of producing a hot-dip metal coated steel strip according to claim 1, wherein a temperature T (° C.) of the gas immediately after being discharged from a tip of each of the gas wiping nozzles is controlled to satisfy $T_M - 150 \leq T \leq T_M + 250$ in relation to a melting point $T_M$ (° C.) of the molten metal.

3. The method of producing a hot-dip metal coated steel strip according to claim 2, wherein the gas is an inert gas.

4. The method of producing a hot-dip metal coated steel strip according to claim 1, wherein the gas is an inert gas.

* * * * *